US005832610A

United States Patent [19]

Chaplick

[11] Patent Number: 5,832,610

[45] Date of Patent: Nov. 10, 1998

[54] NAIL CLIPPER AND RECEPTACLE ASSEMBLY

[76] Inventor: Frank G. Chaplick, 7398 W. Kristal Way, Glendale, Ariz. 85308

[21] Appl. No.: 871,151

[22] Filed: Jun. 9, 1997

[51] Int. Cl.[6] ..... A45D 29/02

[52] U.S. Cl. ..... 30/28; 30/124; 132/75.5

[58] Field of Search ..... 30/28, 124; 132/73.5, 132/75, 75.5

[56] References Cited

U.S. PATENT DOCUMENTS

| | | | |
|---|---|---|---|
| 2,515,852 | 7/1950 | Bilsky | 30/28 |
| 3,169,312 | 2/1965 | Fink | 30/28 |
| 3,188,737 | 6/1965 | Chase | 30/28 |
| 4,150,481 | 4/1979 | Min | 30/28 |
| 4,640,011 | 2/1987 | Gamble | 30/28 |
| 4,731,927 | 3/1988 | Wilson | 30/28 |
| 4,776,090 | 10/1988 | Grassi | 30/28 |
| 4,996,771 | 3/1991 | Williams | 30/28 |
| 5,010,644 | 4/1991 | Goench | 30/28 |
| 5,072,511 | 12/1991 | Ro | 30/28 |
| 5,323,537 | 6/1994 | Ohori | 30/28 |

*Primary Examiner*—Hwei-Siu Payer

*Attorney, Agent, or Firm*—Parsons & Goltry; Michael W. Goltry; Robert A. Parsons

[57] ABSTRACT

A nail clipper including substantially coextensive first and second cutting elements having a receptacle assembly including a receptacle secured laterally along one side of the nail clipper proximate cutting edges of the nail clipper permitting the first and second cutting elements to move together to clip a nail, the receptacle assembly simultaneously forming an enclosure operative for directing nail fragments into the receptacle for capturing the nail fragments.

18 Claims, 3 Drawing Sheets

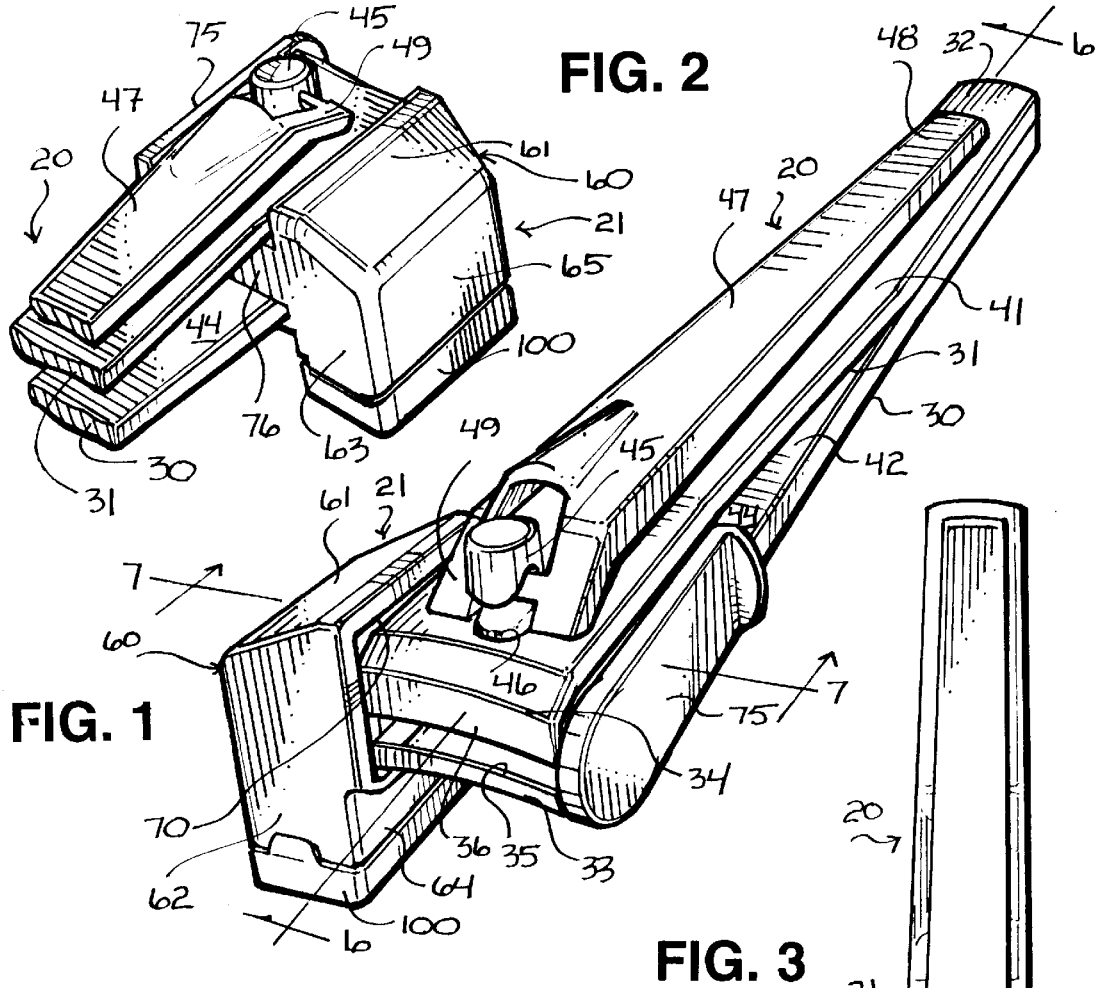
FIG. 2
FIG. 1
75
45
49
47
20
61
60
21
65
44
100
76
63
30
31
48
32
6
41
42
46
7
34
70
62
36
35
33
64
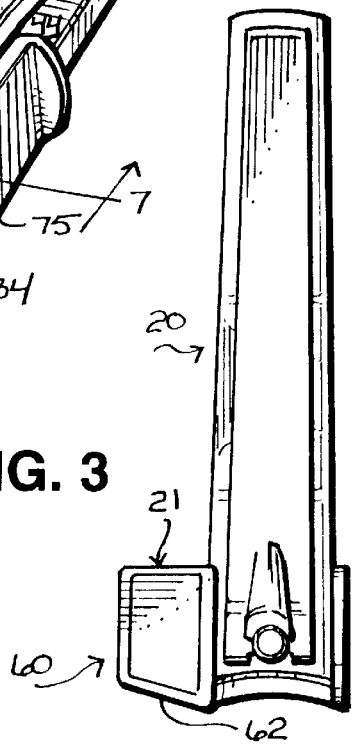
FIG. 3
20
21
60
62
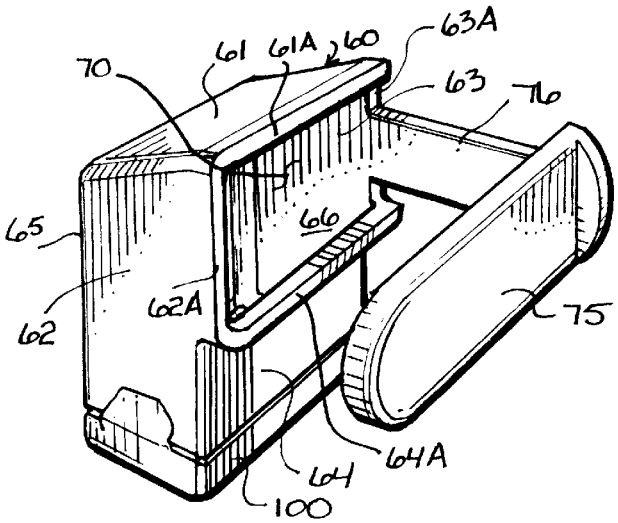
FIG. 5
70
61
61A
60
63A
63
76
65
66
62
62A
75
64
64A
100
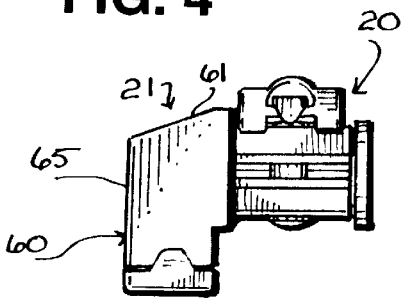
FIG. 4
20
21
61
65
60

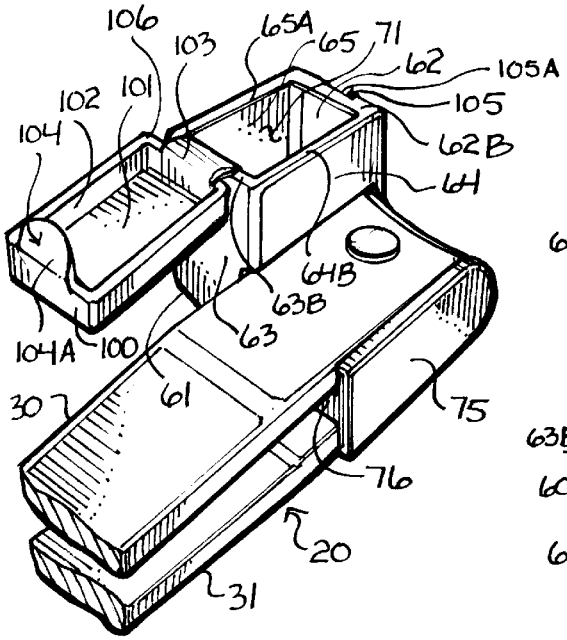
FIG. 9
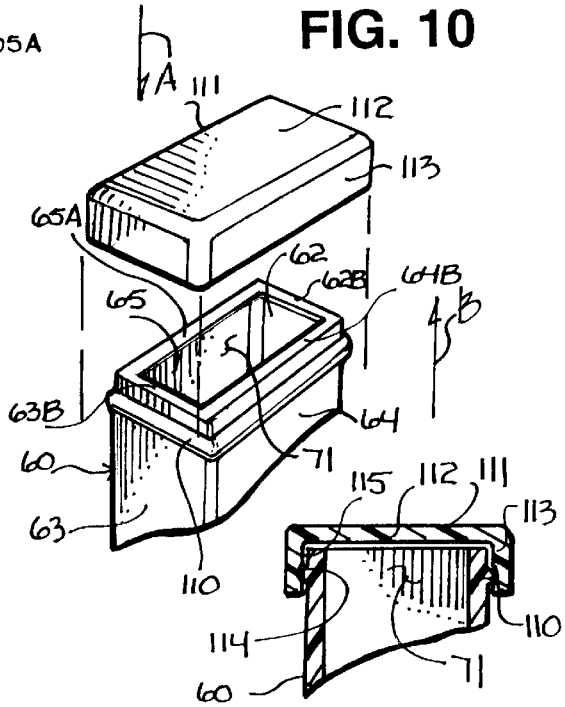
FIG. 10
FIG. 11
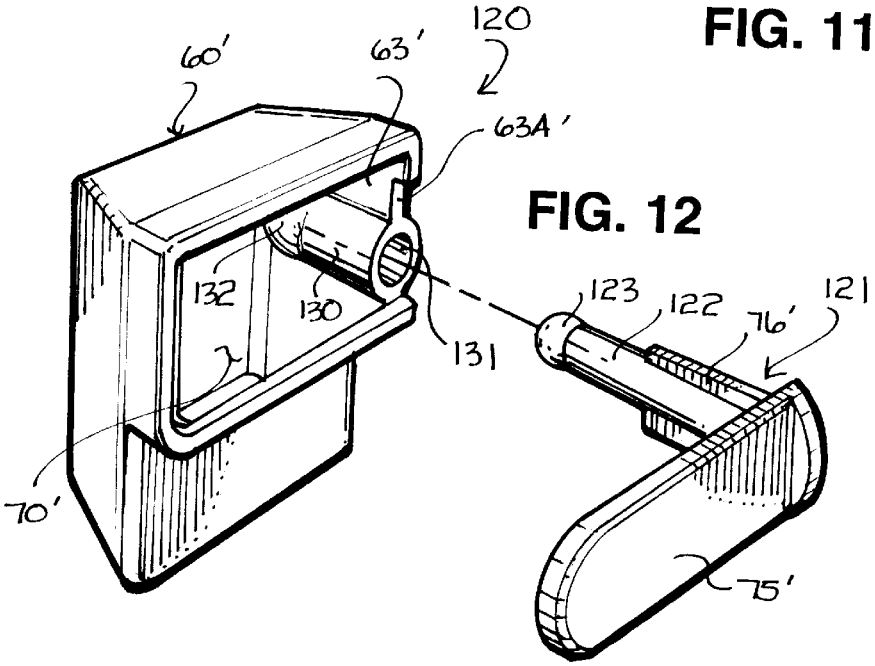
FIG. 12

NAIL CLIPPER AND RECEPTACLE ASSEMBLY

BACKGROUND OF THE INVENTION

1. Field of the Invention

This invention relates generally to the field of manicuring equipment.

More particularly, this invention relates to nail clippers.

In a further and more specific aspect, the instant invention relates to a receptacle assembly for use with a nail clipper for capturing nail fragments during use of the nail clipper.

2. Prior Art

The prior art is replete with a variety manicuring items exemplary for treating hands, fingernails, feet and toenails. Because proper an ongoing care of feet and hands has proven to enhance the health, welfare and beauty of individuals, considerable effort has been directed toward improving manicuring items for enhancing safety and ease of use.

In particular, nail clippers have been objects of considerable innovation. Nail clippers are well known manicuring items exemplary for cutting and trimming toenails. However, it has been noticed that during use of nail clippers, fingernail and toenail fragments produced during use of the nail clipper tend to fall or project from the nail clipper to become undesirably scattered or strewn upon the floor, countertop or other area adjacent the user. To desirably contain nail fragments during use of a nail clipper, the prior art has devised numerous apparatus suitable for capturing or otherwise containing nail fragments during use of the nail clipper for preventing the nail fragments from falling or otherwise projecting from the nail clipper to become undesirably scattered or strewn upon the ground. Although suitable for intended use, the foregoing prior art apparatus have proven difficult to construct and incapable of allowing a user to easily dispose of the nail fragments after use. The foregoing and other shortcomings inherent in prior art therefore occasion certain new and useful improvements operative fore increasing the ease and convenience of capturing and disposing of nail fragments during use of a nail clipper.

Accordingly, it is an object of the present invention to provide a receptacle assembly operative for advantageously capturing nail fragments during use of a nail clipper.

Another object of the present invention is to provide a receptacle assembly that is easy to construct.

And another object of the present invention is to provide a receptacle assembly that is easy to use.

Still another object of the present invention is to provide a receptacle assembly operative for not only advantageously capturing nail fragments during use of a nail clipper, but also operative for allowing the easy and convenient disposal of the nail fragments.

Yet another object of the instant invention is to provide a receptacle assembly that may be easily mounted to a nail clipper.

Yet still another object of the instant invention is to provide a receptacle assembly that is inexpensive.

And a further object of the invention is to provide a receptacle assembly that is efficient.

Still a further object of the immediate invention is to provide a receptacle assembly that requires no modification to an existing nail clipper.

Yet a further object of the invention is to provide a receptacle assembly that encourages individuals to trim and cut their fingernails and toenails.

And still a further object of the invention is the provision of preventing nail fragments for scattering about upon the ground, countertop or other area during use of a nail clipper.

SUMMARY OF THE INVENTION

Briefly, to achieve the desired objects of the instant invention in accordance with a preferred embodiment thereof, provided is a receptacle assembly for use with a nail clipper for capturing nail fragments from the nail clipper during normal and customary use of the nail clipper. The nail clipper includes substantially coextensive first and second cutting elements secured at a proximal end and extending forwardly therefrom in outwardly flexibly biased and diverging relation relative each other and terminating with distal ends having inwardly directed cutting edges, the first and second cutting elements having outer surfaces and opposing inner surfaces defining a gap therebetween intermediate the proximal end and the distal ends. The nail clipper further includes a stud engaged with the first cutting element and extending away from the inner surface thereof and through an aperture of the second cutting element and a lever coupled with the stud in opposition to the outer surface of the second cutting element operative for effecting a closing of the cutting edges for the severance of a portion of a nail positioned between the cutting edges.

The receptacle assembly of the present invention includes a receptacle for capturing nail fragments including a top panel, side panels, an inner end panel and an outer end panel cooperating together to bound a chamber and having laterally disposed edges of the top panel, the inner end panel and the side panels correspondingly bounding a proximal opening into the chamber in communication with the gap of the nail clipper in laterally disposed relation proximate one side of the first and second cutting elements and extending from the cutting edges of the nail clipper to a point rearward of the cutting edges. Further included are distal edges of the inner end panel, the outer end panel and the side panels correspondingly bounding a distal opening into the chamber generally subjacent the nail clipper. A shield is also provided laterally disposed adjacent another side of the first and second cutting edges and substantially coextensive with the proximal opening and interconnected to the receptacle by virtue of a plug traversing the gap interconnecting the receptacle with the shield, the proximal opening, the shield and the plug cooperating together to enclose the gap throughout substantially the entire extent of the proximal opening. A cap may also be provided engagable with the receptacle proximate the distal opening thereof to serve as a closure for the distal opening.

BRIEF DESCRIPTION OF THE DRAWINGS

The foregoing and further and more specific objects and advantages of the instant invention will become readily apparent to those skilled in the art from the following detailed description of preferred embodiments thereof taken in conjunction with the drawings in which:

FIG. 1 illustrates a perspective view of a nail clipper having a receptacle assembly for capturing nail fragments during use of the nail clipper, in accordance with a preferred embodiment of the present invention;

FIG. 2 illustrates a fragmented perspective view of the nail clipper and receptacle assembly of FIG. 1;

FIG. 3 illustrates a top plan view of the nail clipper and the receptacle assembly of FIG. 1;

FIG. 4 illustrates a front elevational view of the nail clipper and receptacle assembly of FIG. 1;

FIG. 5 illustrates a perspective view of the receptacle assembly first shown in combination with FIG. 1;

FIG. 9 illustrates a bottom perspective view of the nail clipper and receptacle assembly of FIG. 1, further illustrating a cap operative as a closure for a distal opening of a receptacle of the receptacle assembly;

FIG. 10 illustrates a fragmented perspective view of a receptacle of the receptacle assembly of FIG. 1 further including a complemental engagement element detachably engagable with an alternate embodiment of cap operative as a closure for a distal opening of the receptacle;

FIG. 11 is a vertical sectional view of the cap of FIG. 10 shown engaged with the receptacle of FIG. 10 enclosing a distal opening thereof; and FIG. 12 Illustrates an exploded perspective view of an alternate embodiment of a receptacle assembly for use with a nail clipper, the receptacle assembly including a receptacle and a shield element detachably engagable with the receptacle.

DETAILED DESCRIPTION OF THE PREFERRED EMBODIMENT

Figure 6:
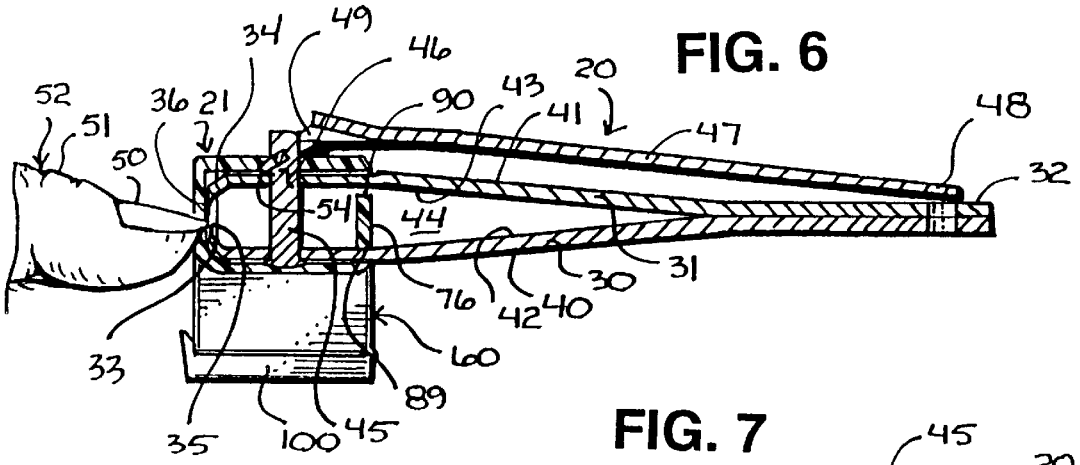
FIG. 6 illustrates a sectional view taken along line 6—6 of FIG. 1 further showing a fingernail positioned between cutting blades of the nail clipper.

Turning now to the drawings, in which like reference characters indicate corresponding elements throughout the several views, attention is first directed to FIG. 1 illustrating a perspective view of a nail clipper 20 having a receptacle assembly 21 for capturing nail fragments during use of nail clipper 20, in accordance with a preferred embodiment of the present invention. Consistent with the advantageous teachings of the present invention to be herein presently discussed, receptacle assembly 21 is not only operative for desirably capturing nail fragments during operation of nail clipper 20, but also operative for allowing a user to easily and conveniently disposed of the nail fragments so collected.

In this regard, and with continuing reference to FIG. 1 and additional reference to FIG. 6 illustrating, among other things, a sectional view taken along line 6—6 of FIG. 1, nail clipper 20 includes substantially coextensive first and second cutting elements 30 and 31. First and second cutting elements 31 and 32 are secured at a proximal end 32 and extend forwardly therefrom in outwardly flexibly biased and diverging relation relative each other and terminate with distal ends 33 and 34, respectively, having inwardly directed cutting edges 35 and 36, respectively. First and second cutting elements 30 and 31 further include outer surfaces 40 (not shown in FIG. 1) and 41 and opposing inner surfaces 42 and 43 (not shown in FIG. 1), respectively, inner surfaces 42 and 43 defining a gap 44 therebetween intermediate proximal end 32 and distal ends 33 and 34. Nail clipper 20 still further includes a stud 45 engaged with first cutting element 30 and extending away from the inner surface 42 thereof and through an aperture 46 of second cutting element 31. A lever 47 is also provided having an outer end 48 and an inner end 49 coupled with a groove 54 formed into stud 45 and in opposition to outer surface 41 of second cutting element 31. Lever 47 is operative for effecting a closing of cutting edges 35 and 36 from a normal open position with cutting edges 35 and 36 disposed in a normal spaced apart configuration to a closed position for the severance of a portion of a nail 50 (FIG. 6) carried by a finger 51 of a human hand 52 and positioned between cutting edges 35 and 36.

It will be readily understood by those having regard toward the relevant art that the foregoing structural features of nail clipper 20 are consistent with known and conventional nail clippers suitable for allowing a user to easily cut or trim his or her fingernails and toenails. As a result, further and more specific details of nail clipper 20 will not be herein further addressed as they will readily occur to the skilled artisan.

Regarding FIG. 5, and preferably constructed of plastic or other suitable material, receptacle assembly 21 includes a receptacle 60 having a top panel 61, side panels 62 and 63, an inner end panel 64 and an outer end panel 65 cooperating together to bound a chamber 66. Top panel 61, inner end panel 64 and side panels 62 and 63 each include a laterally disposed edge 61A, 64A, 62A and 63A, respectively, cooperating together and correspondingly bounding a proximal opening 70 into chamber 66. With momentary attention to FIG. 9, inner end panel 64, outer end panel 65 and side panels 62 and 63 each further extend away from top panel 61 and each terminate with a distal edge 64B, 65A, 62B and 63B, respectively, at a point generally subjacent or otherwise spaced from proximal opening 70 (not shown in FIG. 9) and cooperating together and correspondingly bounding a distal opening 71 into chamber 66.

With reference back to FIG. 5, receptacle assembly 21 further includes a shield 75 spaced from, generally parallel to and generally coextensive with proximal opening 70 of receptacle 60 and interconnected to receptacle 60 by virtue of a plug 76. Consistent with the advantageous teachings of the present invention, shield 75 and plug 76 are each preferably substantially planar, although this is not an essential feature.

Figure 7:
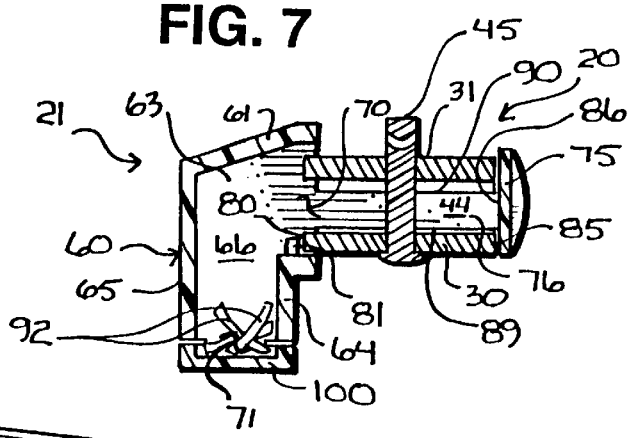
FIG. 7 illustrates a sectional view taken along line 7—7 of FIG. 1.

With attention directed back to FIG. 1 and additional reference to FIG. 2 and FIG. 7 illustrating a sectional view taken along line 7—7 of FIG. 1, receptacle assembly 21 is engagable with nail clipper 20 in a manner operative for advantageously collecting nail fragments from nail clipper during use thereof with proximal opening 70 (not shown in FIG. 2) disposed in communication with gap 44 of the nail clipper 20 in laterally disposed relation proximate one side of first and second cutting elements 30 and 31 and extending from cutting edges 35 and 36 (not shown in FIGS. 2 and 6) of the nail clipper 20 to a point rearward of cutting edges 35 and 36. Regarding a preferred embodiment thereof, receptacle assembly 21 is preferably located proximate distal ends 33 and 34 (not shown in FIGS. 2 and 6) of first and second cutting elements 30 and 31, respectively, with side panel 62 directed forwardly toward cutting edges 35 and 36, proximal opening 70 preferably extending from cutting edges 35 and 36 of nail clipper 20 to a point slightly rearward of stud 45 and spaced from proximal end 32 of nail clipper 20, and receptacle 60 extending downwardly from nail clipper 20 with distal opening 71 residing at a point generally subjacent cutting edges 35 and 36, of which is clearly shown in FIG. 7. Consistent with the preferred teachings, shield 75 is correspondingly positionable laterally adjacent another side of the first and second cutting elements 30 and 31 and substantially coextensive with proximal opening 70 with plug 76 (not shown in FIG. 1) traversing gap 44 slightly rearward of stud 45 interconnecting receptacle 60 with shield 75. In this manner of installation, proximal opening 70, shield 75 and plug 76 correspondingly cooperate together to enclose gap 44 throughout substantially the entire extent of proximal opening 70 and shield 75.

It will be generally understood that nail clippers of the variety chosen herein for the purposes of discussion may be provided in a variety of sizes, some of which may be designed of a size suitable for cutting fingernails and others designed of a size suitable for cutting toenails. Therefore, in accordance with the teachings of the instant invention, receptacle assembly 21 and alternate embodiments thereof may be constructed of any size suitable for engagement in the foregoing manner to nail clippers of correspondingly varying size.

Nevertheless, with momentary reference to FIG. 3 illustrating a top plan view of nail clipper 20 and receptacle assembly 21 shown coupled thereto in the foregoing manner, side panel 62 is shown angled somewhat rearwardly from the cutting edges of nail clipper 20. Although this is not an essential feature of the present invention, it operates to prevent receptacle 60 of receptacle assembly 21 from obstructing use of nail clipper 20 during normal and customary operation of the nail clipper. Furthermore, as shown in FIG. 4 illustrating a front elevational view of nail clipper 20 and receptacle assembly 21 shown coupled thereto, top panel 61 of receptacle is shown angled somewhat upwardly away from outer end panel 65 toward nail clipper 20, although this is not an essential feature.

Figure 8:
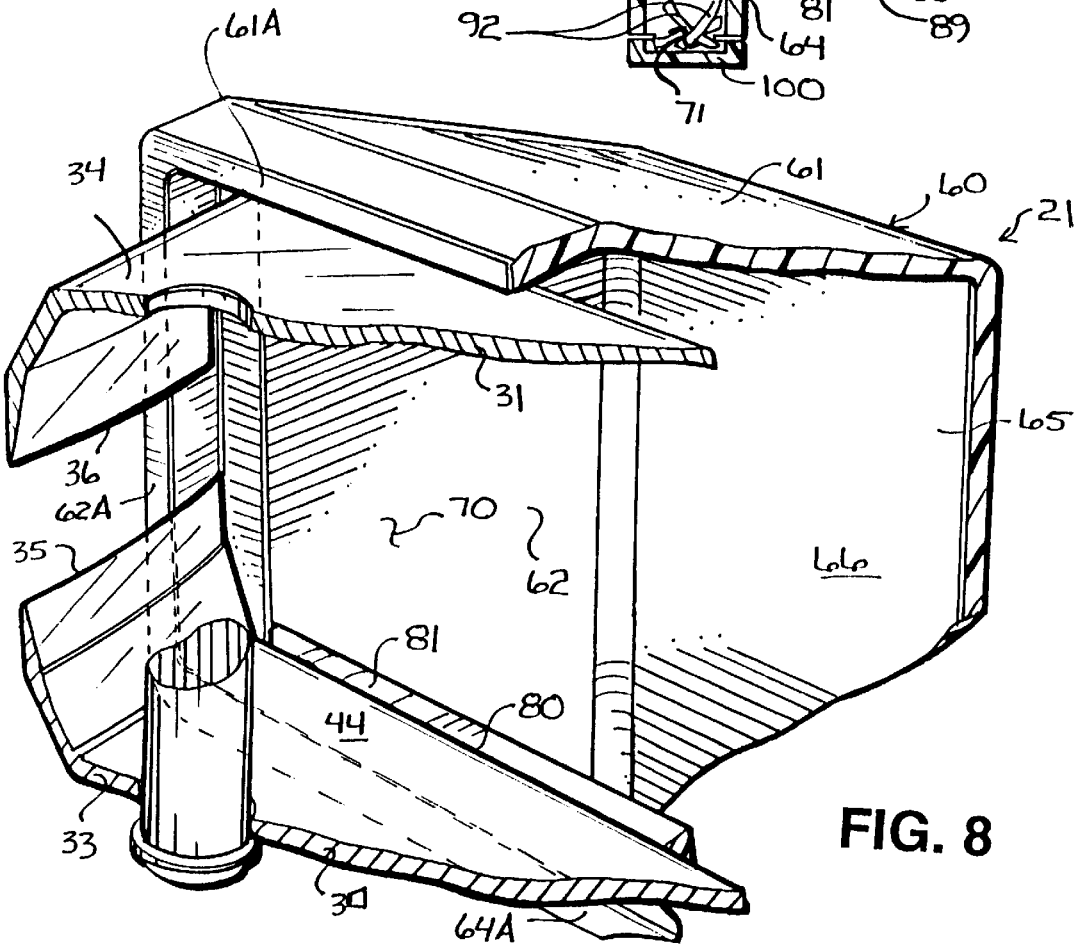
FIG. 8 illustrates an enlarged fragmented perspective view of the nail clipper and receptacle assembly of FIG. 1.

To secure or otherwise affix receptacle assembly 21 to nail clipper 20, portions of receptacle 60 defining proximal opening 70 may be secured to portions of an outer edge of first cutting element 30 extending therealong, and portions of shield 75 may be secured to portions of another outer edge of first cutting element 30 extending therealong with the second cutting element freely and desirably residing proximate proximal opening 70 thereby facilitating communication between gap 44 and chamber 66 of receptacle 60 and the free movement of second cutting element 31 during operation of nail clipper 20 during normal operation thereof. In this regard, and with momentary attention to FIG. 8 illustrating an enlarged fragmented perspective view of first and second cutting elements 30 and 31 of clipper 20 proximate the distal ends 33 and 34 thereof and receptacle 60 of receptacle assembly 21, first cutting element 30 includes a first outer edge 80 directed toward receptacle 60 and residing against an end wall 81 in proximal opening 70 formed slightly inboard of laterally disposed edge 64A of inner end panel 64 (not shown). To desirably secure receptacle 60 to nail clipper 20, a suitable adhesive may be introduced between first outer edge 80 and end wall 81 operative for adhesively and fixedly securing nail clipper 20 to receptacle 60 of receptacle assembly 21. However, it will be generally understood that other suitable engagement mechanisms may be employed for securing first outer edge 80 to end wall 81.

With first cutting element 30 secured to receptacle 60 in the foregoing manner, second cutting element 31 will reside proximate distal opening 70 and freely movable therein for facilitating normal and conventional operation of nail clipper 20. Furthermore, although not essential to the various objects and advantages of the present invention, portions of cutting edges 35 and 36 directed toward receptacle 60 are shown located against end wall 81 somewhat inboard of laterally disposed edge 62A operative for facilitating communication of nail fragments through proximal opening 70 from gap 44 to chamber 66 of receptacle 60, further details of which will be presently discussed. However, it will be generally understood that end wall 81 is not an essential for proper operation of receptacle assembly 21 and that first outer edge 80 of first cutting element 30 may be alternatively engaged directly to laterally disposed edge 64A with the portions of cutting edges 35 and 36 directed toward receptacle 60 to reside in substantially flush relation with laterally disposed edge 62A.

With momentary reference back to Fig. 7, first cutting element 30 further includes a second outer edge 85 directed toward and adjacent to portions of an inner surface 86 of shield 75 directed inward toward gap 44. To further the securement of receptacle assembly 21 to nail clipper 20, a suitable adhesive may be introduced between second outer edge 85 and inner surface 86 of shield 75 operative for adhesively and fixedly securing nail clipper 20 to receptacle 60 of receptacle assembly 21 with second cutting element 31 being substantially flush with and freely movable along inner surface 86 of shield 75 during normal operation thereof. However, it will be generally understood that other suitable engagement mechanisms may be employed for securing second outer edge 85 to inner surface 86 of shield 75 if so desired.

Regarding FIG. 6 and FIG. 7, plug 76 includes a lower end 89 and an upper end 90 such when receptacle assembly 21 is properly installed in accordance with the foregoing discussion, will extend upwardly proximate inner surface 42 of first cutting element 30 and terminate with upper end 90 thereof spaced from inner surface 43 of second cutting element 31 a distance generally equal to the distance between cutting edges 35 and 36 in the normal open position of first and second cutting elements 30 and 31. In this manner, upon movement of first and second cutting elements 30 and 31 in operation to the closed position for effecting the severance of a nail between cutting edges 35 and 36, second cutting element 31 will move toward and reside adjacent upper end 90 of plug thereby effecting the enclosure of a portion of gap 44 by proximal opening 70, plug 76 and shield 75. Thus, upon severance of a nail to form a nail fragment, the nail fragment will dislodge and project inwardly into the portion of gap 44 bound by proximal opening 70, plug 76 and shield 75, project or otherwise deflect off of either plug 76 and/or shield 75 into and through proximal opening 70 and then downwardly toward distal opening 71 for receipt within chamber 66 of receptacle 60, FIG. 7 illustrating a plurality of such nail fragments 92 advantageously retained within chamber 66.

As can be seen in FIGS. 1, 2, 5, 6 and 7, receptacle assembly 21 further includes a cap 100 engagable with receptacle 60 proximate distal opening 71 thereof to serve as a closure for distal opening 71 for suitably retaining nail fragments 92 received within chamber 66 when cap 100 is in a closed position. Regarding FIG. 9, cap 100 is constructed of a size sufficient to encompass distal opening 71 and includes cap wall 101 having a continuous sidewall 102 extending outwardly therefrom. A living hinge 103 interconnects a rearward end 106 of cap 100 to receptacle 60 at side panel 63 proximate distal opening 71. Further provided is an engagement element 104 carried by cap 100 proximate a forward end 107 thereof. Cap 100 is movable about living hinge 103 from an open position as shown in FIG. 9 along pivotal traverse to a closed position as shown in FIGS. 1, 2, 5, 6 and 7 with engagement element 104 detachably engagable with a complemental engagement element 105 (shown only in FIG. 9) carried by receptacle at side panel 62, and the closed position along pivotal traverse to the open position. Regarding the specific embodiment chosen herein for the purposes of discussion, engagement element 104 includes a normally inwardly biased protrusion 104A extending outwardly from forward end 107 of cap 100, and complemental engagement element 105 includes a recess 105A formed into side panel 62 proximate distal opening 71 of receptacle 60, the normally inwardly biased protrusion 104A being detachably engagable with the recess 105A when cap 100 is moved into the closed position. It will be generally understood by those having ordinary skill that engagement element 104 and complemental engagement element 105 may be provided having a variety of structural features consistent with the teachings herein without departing from the nature and scope of the present invention as herein specifically described.

Referring back to FIG. 7, with nail fragments retained and collected within chamber 66 of receptacle 60, a user may simply grip cap 100 and move it to the open position thereby allowing the user to properly discard nail fragments 92, for instance, into a trash can. Once nail fragments 92 have been discarded from chamber 66, the user may close cap 100 and resume normal and customary use of nail clipper 20.

With attention directed to FIG. 10, shown is a perspective view of receptacle 60 having a continuous bead 110 formed therealong side panels 62 and 63, inner end panel 64 and outer end panel 65 extending outwardly therefrom and operative a complemental engagement element detachably engagable with an engagement element carried by an alternate embodiment of a cap 111 suitable as a closure for distal opening 71. Like cap 100, and with additional reference to FIG. 11 illustrating a vertical sectional view of receptacle 60 and cap 111 shown as it would appear engaged with receptacle 60, cap 111 is constructed of a size sufficient to encompass distal opening 71 and includes cap wall 112 having a continuous sidewall 113 extending outwardly therefrom with a continuous groove 114 (shown only in FIG. 11) formed into an inner surface 115 (shown only in FIG. 11) of continuous sidewall 113. Continuous groove 114 is detachably engagable with continuous bead 110 upon application of axial compressive force against cap 11 in the direction indicated by the arrowed line A in FIG. 10 toward distal opening 71 operative for closing distal end 71. To open distal end 71, a user need only grasp cap 111 and pull it away from distal opening 71 in the direction indicated by the arrowed line B in FIG. 10.

The present invention has been described above with reference to a preferred embodiment. However, those skilled in the art will recognize that changes and modifications may be made in the described embodiments without departing from the nature and scope of the present invention. For example, FIG. 12 illustrates an alternate embodiment of a receptacle assembly being generally designated by the reference character 120. Receptacle assembly 120, in general similarity to receptacle assembly 21 herein previously discussed, includes substantially the same elements. Accordingly, the same relevant reference characters used to describe receptacle assembly 21 will also be used to describe receptacle assembly 120. However, for clarity and ease of discussion, common reference characters used with receptacle assembly 120 will be denoted with a prime "'" symbol.

In this regard, receptacle assembly includes receptacle 60' and shield 75' shown secured to plug 76'. Shield 75' and plug 76' represent a shield assembly generally denoted by the reference character 121 of which is detachably engagable with receptacle 60'. In a further and more specific aspect, shield assembly 121 includes a male engagement element extending outwardly from shield 75' contiguous with plug 76' and terminating with an enlarged head 123. Receptacle 60' includes a female engagement element 130 provided in the form of a socket 131 formed with side panel 63' and extending inwardly from laterally disposed edge 63' and terminating inwardly therefrom with an enlarged portion 132. In this manner of construction, and consistent with the manner of installation discussed previously in combination with receptacle assembly 21, receptacle assembly 120 may be detachably engaged with nail clipper 20 (not shown in FIG. 12) by placing receptacle 60' along one side of nail clipper 20 with proximal opening 70' disposed in communication with gap 44 proximate the distal ends 34 and 35. Male engagement element 122 may then be inserted into and through gap 44 from the other side of nail clipper 20 and inserted into and through socket 131 of female engagement element 130 with enlarged head 123 of male engagement element 122 to detachably secure within enlarged portion 132 of female engagement element 130 thereby detachably securing shield assembly 121 to receptacle 60' and receptacle assembly 120 to nail clipper 20. Upon installation, shield assembly 121 and receptacle 60' will grip nail clipper 20 with sufficient force thereby facilitating securement of receptacle assembly 120 to nail clipper without the need for additional mechanical securement such as with a suitable adhesive or other suitable mechanical fastening mechanism. Therefore, after use thereof, a user may detach receptacle assembly 120 from nail clipper 20 by reversing the foregoing operation if desired.

Although shield assembly 121 and receptacle 60' have been herein specifically disclosed in the foregoing alternate embodiment as being detachably engagable by virtue of male and female engagement elements, it will be readily understood by those having regard toward the relevant art that other suitable mechanical and complemental engagement elements may be used suitable for detachably engaging shield assembly 121 with receptacle 60' without departing from the nature and scope of the present invention as herein specifically described.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A nail clipper, comprising:

substantially coextensive first and second cutting elements secured at a proximal end and extending forwardly therefrom in outwardly flexibly biased and diverging relation relative to each other and terminating with distal ends having inwardly directed cutting edges, said first and second cutting elements having outer surfaces and opposing inner surfaces defining a gap therebetween intermediate said proximal end and said distal ends;

a stud engaged with said first cutting element and extending away from said inner surface thereof and through an aperture of said second cutting element;

a lever coupled with said stud in opposition to said outer surface of said second cutting element operative for effecting a closing of said cutting edges for the severance of a portion of a nail positioned between said cutting edges;

a receptacle for capturing nail fragments including a chamber, a proximal opening into said chamber in communication with the gap of the nail clipper in laterally disposed relation proximate one side of the first and second cutting elements and extending from the cutting edges of the nail clipper to a point rearward of the cutting edges, and a distal opening into said chamber spaced from said proximal opening;

a shield laterally disposed adjacent the other side of the first and second cutting elements and substantially coextensive with said proximal opening;

a plug traversing the gap interconnecting said receptacle with said shield, said proximal opening, said shield and said plug cooperating together to enclose the gap throughout substantially the entire extent of said proximal opening; and a cap engagable with said receptacle proximate said distal opening thereof to serve as a closure for said distal opening.

2. The nail clipper of claim 1, further including:

a living hinge interconnecting a rearward end of said cap to said receptacle proximate said distal opening;

an engagement element carried by said cap proximate a forward end thereof; and a complemental engagement element carried by said receptacle and spaced from said living hinge;

said cap movable about said living hinge from an open position along pivotal traverse to a closed position with said engagement element detachably engagable with said complemental engagement element, and the closed position along pivotal traverse to the open position.

3. The nail clipper of claim 2, wherein said engagement element includes a normally inwardly biased protrusion extending outwardly from said forward end of said cap.

4. The nail clipper of claim 3, wherein said complemental engagement element includes a recess formed into said receptacle, said normally inwardly biased protrusion being detachably engagable with said recess in the closed position of said cap.

5. The nail clipper of claim 1, further including:

an engagement element carried by said cap;

a complemental engagement element carried by said receptacle;

said engagement element of said cap detachably engagable with said complemental engagement element of said receptacle upon application of axial compressive force to said cap in a direction toward said distal opening.

6. The nail clipper of claim 1, wherein said plug is fixedly engaged with said receptacle and said shield.

7. The nail clipper of claim 1, wherein said plug is fixedly engaged with said shield and detachably engagable with said receptacle by virtue of an engagement assembly including an engagement element carried by said plug and a complemental engagement element carried by said receptacle, said engagement element of said engagement assembly being detachably engagable with said complemental engagement element of said engagement assembly.

8. The nail clipper of claim 7, wherein said engagement element of said engagement assembly includes a male engagement element.

9. The nail clipper of claim 8, wherein said complemental engagement element of said engagement assembly includes a female engagement element.

10. A receptacle assembly for use with a nail clipper of a type having substantially coextensive first and second cutting elements secured at a proximal end and extending forwardly therefrom in outwardly flexibly biased and diverging relation relative to each other and terminating with distal ends having inwardly directed cutting edges, the first and second cutting elements having outer surfaces and opposing inner surfaces defining a gap therebetween intermediate the proximal end and the distal ends, a stud engaged with the first cutting element and extending away from the inner surface thereof and through an aperture of the second cutting element and a lever coupled with the stud in opposition to the outer surface of the second cutting element operative for effecting a closing of the cutting edges for the severance of a portion of a nail positioned between the cutting edges, the receptacle assembly engagable with the nail clipper for capturing nail fragments from the nail clipper during operation thereof, said receptacle assembly comprising:

a receptacle bounding a chamber, said receptacle further including a proximal opening into said chamber in communication with the gap of the nail clipper in laterally disposed relation proximate one side of the first and second cutting elements and extending from the cutting edges of the nail clipper to a point rearward of the cutting edges, and a distal opening into said chamber spaced from said proximal opening;

a shield laterally disposed adjacent the other side of the first and second cutting elements and substantially coextensive with said proximal opening;

a plug traversing the gap interconnecting said receptacle with said shield, said proximal opening, said shield and said plug cooperating together to enclose the gap throughout substantially the entire extent of said proximal opening; and a cap engagable with said receptacle proximate said distal opening thereof to serve as a closure for said distal opening.

11. The receptacle assembly of claim 10, further including:

a living hinge interconnecting a rearward end of said cap to said receptacle proximate said distal opening;

an engagement element carried by said cap proximate a forward end thereof; and a complemental engagement element carried by said receptacle and spaced from said living hinge;

said cap movable about said living hinge from an open position along pivotal traverse to a closed position with said engagement element detachably engagable with said complemental engagement element, and the closed position along pivotal traverse to the open position.

12. The receptacle assembly of claim 11, wherein said engagement element includes a normally inwardly biased protrusion extending outwardly from said forward end of said cap.

13. The receptacle assembly of claim 12, wherein said complemental engagement element includes a recess formed into said receptacle, said normally inwardly biased protrusion being detachably engagable with said recess in the closed position of said cap.

14. The receptacle assembly of claim 10, further including:

an engagement element carried by said cap;

a complemental engagement element carried by said receptacle;

said engagement element of said cap detachably engagable with said complemental engagement element of said receptacle upon application of axial compressive force to said cap in a direction toward said distal opening.

15. The receptacle assembly of claim 10, wherein said plug is fixedly engaged with said receptacle and said shield.

16. The receptacle assembly of claim 10, wherein said plug is fixedly engaged with said shield and detachably engagable with said receptacle by virtue of an engagement assembly including an engagement element carried by said plug and a complemental engagement element carried by said receptacle, said engagement element of said engagement assembly being detachably engagable with said complemental engagement element of said engagement assembly.

17. The receptacle assembly of claim 16, wherein said engagement element of said engagement assembly includes a male engagement element.

18. The receptacle assembly of claim 17, wherein said complemental engagement element of said engagement assembly includes a female engagement element.

* * * * *